US010087635B2

(12) United States Patent
Mucha et al.

(10) Patent No.: US 10,087,635 B2
(45) Date of Patent: Oct. 2, 2018

(54) CURB-MOUNTED SKYLIGHT

(71) Applicant: FAKRO PP Sp. z o. o., Nowy Sącz (PL)

(72) Inventors: Łukasz Mucha, Grybów (PL); Łukasz Stokłosa, Dobra (PL); Warcław Majoch, Nowy Sącz (PL)

(73) Assignee: FAKRO PP Sp. z o. o., Nowy Sacz (PL)

( * ) Notice: Subject to any disclaimer, the term of this patent is extended or adjusted under 35 U.S.C. 154(b) by 0 days.

(21) Appl. No.: 15/446,003

(22) Filed: Mar. 1, 2017

(65) Prior Publication Data

US 2017/0275876 A1 Sep. 28, 2017

(30) Foreign Application Priority Data

Mar. 23, 2016 (PL) ..... 416616

(51) Int. Cl.
*E04D 13/03* (2006.01)
*E06B 3/66* (2006.01)
*E04B 7/18* (2006.01)

(52) U.S. Cl.
CPC ..... *E04D 13/03* (2013.01); *E04B 7/18* (2013.01); *E06B 3/66* (2013.01)

(58) Field of Classification Search
CPC ... E04D 13/03; E04D 13/0305; E04D 13/032; E04D 13/0335; E06B 3/66; E06B 3/6612; E06B 3/663; E06B 3/66304; E06B 3/66309; E04B 7/18
See application file for complete search history.

(56) References Cited

U.S. PATENT DOCUMENTS 4,073,097 A * 2/1978 Jentoft ..... E04D 13/0305 52/200
4,449,340 A * 5/1984 Jentoft ..... E04D 13/0354 428/515
4,570,394 A * 2/1986 Jentoft ..... E04D 13/0354 49/DIG. 2
RE32,539 E * 11/1987 Jentoft ..... E04D 13/0305 49/DIG. 1
4,862,657 A * 9/1989 Jentoft ..... E04D 13/0354 52/200
4,930,275 A * 6/1990 Verby ..... E04D 13/0305 49/DIG. 1
4,972,638 A * 11/1990 Minter ..... E04D 13/031 52/200
5,913,785 A * 6/1999 Møller ..... E04D 13/0305 49/DIG. 1
6,263,623 B1 * 7/2001 Weiss ..... E04D 13/02 49/463
7,624,547 B1 * 12/2009 Brinton ..... E04D 13/0305 52/198

(Continued)

*Primary Examiner* — Andrew J Triggs
(74) *Attorney, Agent, or Firm* — Gokalp Bayramoglu

(57) ABSTRACT

A curb-mounted skylight designed for mounting on a framing protruding from the roof and forming part of its construction. The skylight has a glazing unit (1) and a support frame (2), where the distance (H2) from the skylight support surface to the outermost edge of the protective wall (22) of the section profile of the support frame (2) is not longer than the distance (H1) from the skylight support surface to the outside surface of the glazing unit (1). There is an adhesive sealing joint (5) between the glazing unit (1) and the protective wall (2).

19 Claims, 4 Drawing Sheets

(56) References Cited

U.S. PATENT DOCUMENTS

| | | | | |
|---|---|---|---|---|
| 8,448,393 | B2 * | 5/2013 | Voegele, Jr. | E04D 13/0315 52/200 |
| 9,797,140 | B1 * | 10/2017 | Conklin | E04D 13/0315 |
| 2010/0269426 | A1 * | 10/2010 | Richter | E04D 13/0315 52/171.3 |
| 2017/0275876 | A1 * | 9/2017 | Mucha | E04B 7/18 |

* cited by examiner

CURB-MOUNTED SKYLIGHT

CROSS REFERENCE

This application claims priority from a Polish application P.416616 filed on Mar. 23, 2016, the entire content of which is incorporated herein by reference.

TECHNICAL FIELD

The invention relates to a curb-mounted skylight window, designed for mounting on a framing protruding from the surface of the roof and forming part of its construction. The window may be one a fixed or openable one. The window according to the invention can be used in both so-called flat roofs and sloping roofs.

BACKGROUND

Known from U.S. Pat. No. 7,624,547 (B1) is a skylight designed for mounting on a framing protruding from the roof, fitted with a glazing unit comprising two panes connected with a spacer frame. The glazing unit is secured by means of a frame overlapping the upper surface of the outer pane. This solution hinders the flow of rain water or water from melted snow down the pane, because water collects at the frame protruding above the window pane at the glazing unit's lower edge. This collection of runoff occurs especially in windows installed on flat roofs or those with only a mild incline.

SUMMARY OF INVENTION

The curb-mounted skylight window is designed for mounting on a framing protruding from the surface of a roof and forming part of its construction. It is equipped with a glazing unit comprising at least two panes separated by a space filled with gas, and has a support frame supporting the glazing unit, this being made of a section profile comprising a support wall and a protective wall that surrounds the glazing unit. There is an adhesive fastening joint between the support wall and the peripheral area of the lower pane in the glazing unit, this being applied along all the edges of this pane and forming a compact and integral structure of the glazing unit and its support frame.

The distance from the support surface of the skylight on the framing protruding from the surface of the roof to the outermost edge of the protective wall of the section profile of the support frame for the glazing unit is not longer than the distance from the surface of the skylight's support to the outer surface of the glazing unit. Between the glazing unit and the protective wall there is an adhesive sealing joint. Preferably, the edge of the protective wall of the section profile of the support frame ends slightly below the outer surface of the glazing unit, with the result that the outer surface of the adhesive sealing joint is situated obliquely relative to the outer surface of the glazing unit, forming a chamfered outer edge to the skylight.

The individual panes forming the glazing unit have a rectangular shape, and the widths of these panes are identical in the entire glazing unit, and likewise the lengths of these panes are the same throughout the glazing unit. The window is designed for installation in so-called flat roofs as well as in steeply sloping roofs, and the full range of incline is from 0 to 85 degrees.

The section profile of the glazing unit's support frame, in addition to the support wall and protective wall surrounding the glazing unit, also features a lower protective wall located below the support wall, on an extension of the protective wall. The lower protective wall of the section profile of the glazing unit's support frame surrounds the framing protruding from the roof, shielding it from the effects of the weather.

Preferably, the section profile of the glazing unit's support frame has a rib positioned below the support wall, facing in the same direction, with the result that there is an attachment groove between the rib and the support wall. A profiled strip is mounted in this groove for attaching window accessories located inside the room with this skylight, for example an interior roller blind or strip type shutter. Preferably, the profiled strips are arranged along all sides of the glazing unit, creating a mounting frame for the abovementioned window accessories.

In the first embodiment, the curb-mounted skylight is a fixed one, and the mounting frame for attaching window accessories, located below the glazing unit rests on the mounting frame protruding from the surface of the roof. Preferably, a flat seal is located between the mounting frame and the framing protruding from the roof. A fixed curb-mounted skylight window is secured to the roof by means of intermediate connectors such as screws or nails, which, passing through openings in the lower protective wall of the section profile surrounding the glazing unit, are embedded in the framing protruding from the roof forming part of the roof's construction.

In the second embodiment, the curb-mounted skylight is also a fixed one. It differs from the first embodiment in that, additionally, it features a window frame mounted on the framing protruding from the surface of the roof, attached to that frame, for example by means of threaded fasteners. A mounting frame for window accessories is positioned under the glazing unit, which rests on the window frame. Preferably, a flat seal is located between the mounting frame and the window frame. The glazing unit is attached to the window frame by means of intermediate connectors, such as screws or nails which, passing through openings in the lower protective wall of the section profile surrounding the glazing unit, are embedded in the window frame of the curb-mounted skylight window.

In the third embodiment, the curb-mounted skylight is also a fixed one. This window features a window frame mounted on a framing protruding from the surface of the roof, as in the second embodiment. There is however no mounting frame for window accessories, and instead of this, the support wall of the section profile of the glazing unit's support frame is extended toward the centre of this glazing unit, overlapping the window frame. Preferably, a flat seal is located between this support wall of the section profile of the support frame surrounding the glazing unit, and the window frame. The glazing unit is attached to the window frame in exactly the same way as in the second embodiment.

In the fourth embodiment, the curb-mounted skylight is an openable one. This window features a window frame mounted on a framing protruding from the surface of the roof, as in the second embodiment. The glazing unit and its support frame form part of this window's movable sash, also having a mounting frame for window accessories, the same as in the first and second embodiment. The window sash is connected to the window frame by means of hinges which, on the sash side, are embedded in the mounting frame for window accessories. In the window's closed position, preferably a flat seal is located between the support frame and the window frame.

In the fifth embodiment, the curb-mounted skylight is also an openable one. This window has a window frame mounted on a framing protruding from the surface of the roof, as in the second embodiment. The glazing unit along with its support frame forms part of this window's movable sash, which (as in the third embodiment) has no mounting frame for window accessories, however the support wall of the section profile of the glazing unit's support frame is extended toward the centre of this glazing unit, overlapping the window frame. The window sash is connected to the window frame by means of hinges, which on the sash side are attached to the section profile of its support frame. In the window's closed position, preferably a flat seal is located between the support wall of the section profile of the support frame and the window frame.

In the sixth embodiment, the curb-mounted skylight is a fixed one, and its design is the simplest one of all the embodiments. This window has neither a window frame nor a mounting frame for window accessories; however, the support wall of the section profile of the glazing unit's support frame is extended toward the centre of this glazing unit, overlapping the framing protruding from the surface roof, forming part of its construction. On the lower surface of the support wall of the section profile of the glazing unit's support frame, the window has a seal, preferably mounted in a groove. The window is secured to the roof as in the first embodiment, by means of intermediate fasteners such as screws or nails which, passing through openings in the lower protective wall of the section profile enveloping the glazing unit, are embedded in the framing protruding from the surface of the roof.

In those embodiments of the curb-mounted skylight according to the present invention, that are equipped with a window frame, i.e. in the second, third, fourth and fifth one—additional equipment for the window may be thermal insulation caps, mounted on the outer lateral surfaces of the window frame. Preferably, these thermal insulation caps are extended towards the surface of the roof, with the result that they also overlap the lateral surfaces of the framing protruding from the roof, and so also insulating this area.

A curb-mounted skylight according to the present invention, thanks to the application of the glazing unit's support frame which does not protrude beyond the upper surface of the outer pane, permits the free flow of rainwater or water from melted snow down the pane, which helps to keep the window pane clean and so reduces the frequency of window cleaning operations required. This advantage is particularly important in fixed skylights whose cleaning requires going up onto the roof.

BRIEF DESCRIPTION OF DRAWINGS

The curb-mounted skylight, subject of the present invention, is illustrated in the following drawing, wherein particular figures present the following.

Figure 1:
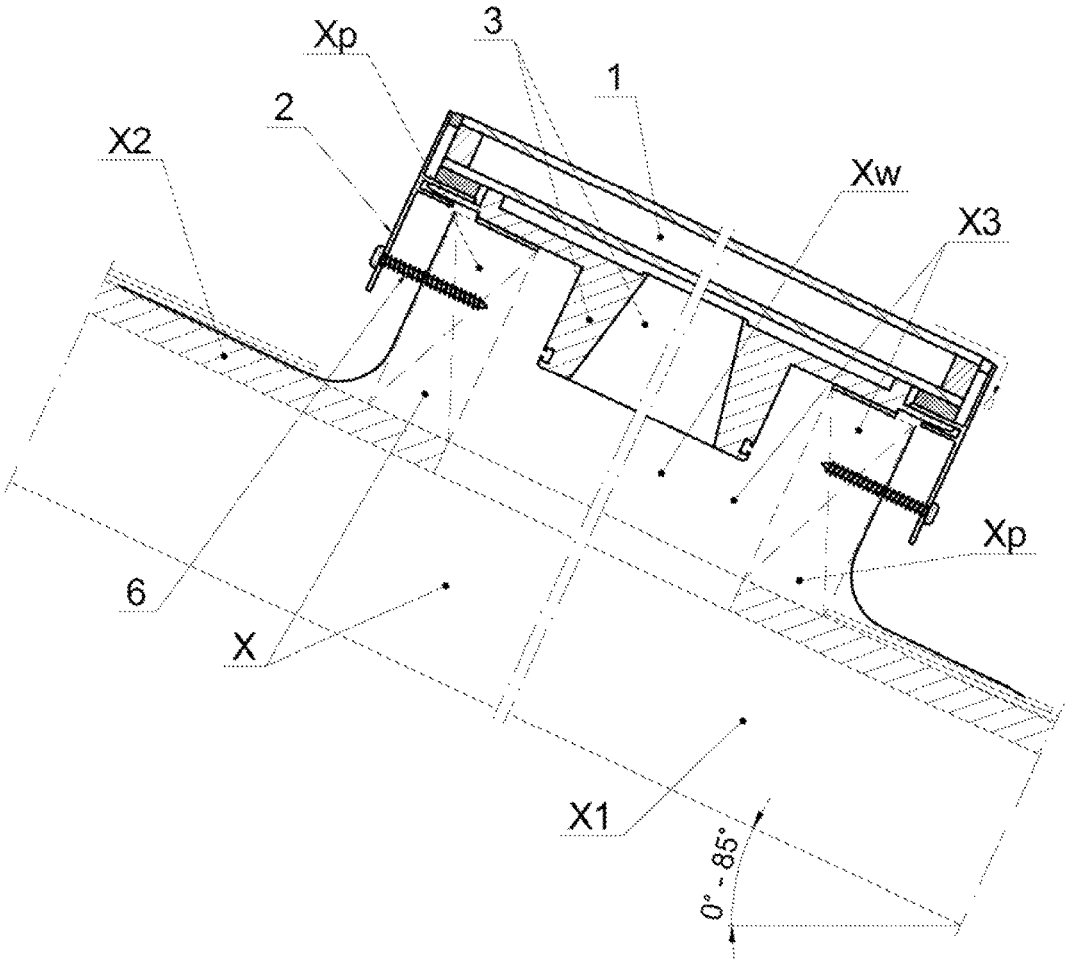
FIG. 1—A roof section with a curb-mounted skylight—in a longitudinal cross-section of the surface parallel to the rafters.

A curb-mounted skylight is also shown in an embodiment not included in the drawing, but described by the identification of common features and differences relative to the embodiments drawn.

DETAILED DESCRIPTION OF INVENTION

Example 1

Figure 2:
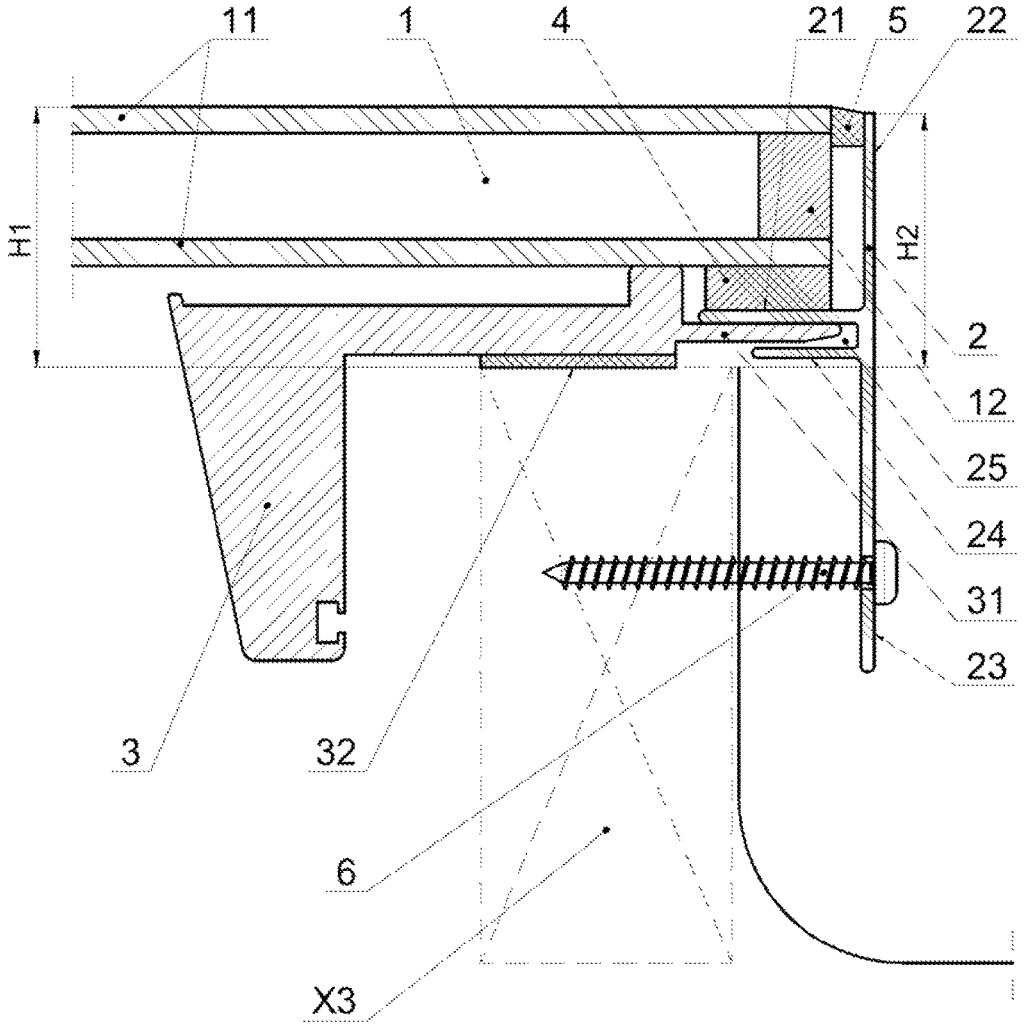
FIG. 2—A skylight with a mounting frame for window accessories, supported on a framing protruding from the roof—as a superimposed cross-section including the edge of the window and the indicated framing.

A fixed curb-mounted skylight, as shown in FIGS. 1 and 2 of the drawing, comprising a rectangular glazing unit 1, surrounded by a support frame 2 made of aluminium alloy section profile. Located under the glazing unit is a rectangular mounting frame 3, in which are to be optionally embedded window accessories, installed in the interior space of the room featuring this skylight, for example a roller shutter or a strip type blind. For the roof structure X, in which a skylight is installed according to the invention, the support elements are rafters X1, and on them rest the roof covering elements X2, which may be any type (not being part of the invention). Extending upwards from the roof X is a framing X3 consisting of two longitudinal rails Xw, parallel to the rafters X1, and two transverse rails Xp arranged horizontally in the roof.

The glazing unit 1 comprises two glass panes 11 connected at their periphery by a spacer frame 12 which encloses the space between the panes 11. The spacer frames 12 and panes 11 are glued together. The space inside the glazing unit 1 is filled with gas, preferably argon. The support frame 2 of the glazing unit 1 is made of section profile having a support wall 21, situated beneath the edge of the lower pane 11 of the glazing unit, and a protective wall 22 that surrounds the glazing unit 1 in a complete support frame 2. On the support wall 21 there is an adhesive fastening joint 4, which forms the integral connection of the glazing unit 1 to the support frame 2. The distance H2 from the support surface of the skylight on framing X3 protruding from the roof to the outermost edge of the protective wall 22 is slightly shorter than the distance H1 from the support surface of the skylight on framing X3 to the outer surface of pane 11 of the glazing unit 1. Between the glazing unit 1 and the protective wall 22 there is an adhesive sealing joint 5, whose outer surface connecting the outer edges of pane 11 of the glazing unit 1 with the protective wall 22 is oblique with respect to the surface of pane 11 thus forming a chamfered outer edge to the skylight. The section profile of support frame 2 also comprises a lower protective wall 23 located below support wall 21 on an extension of protective wall 22. In the assembled support frame, the lower protective walls 23 surrounds the framing X3 protruding from the roof. The lower protective walls 23 also serve for securing the curb-mounted skylight in the roof by means of screws 6 which pass through openings in the lower protective wall 23 and are embedded in the framing X3.

The section profile of support frame 2 also features a rib 24 located below support wall 21 and parallel to it, with the result that between support wall 21 and the rib 24 is formed a groove 25 open to the inner side of support frame 2. The mounting frame 3 for window accessories comprises on its periphery a tongue 31 that enters the groove 25 of support frame 2, thanks to which the mounting frame 3 is connected to support frame 2. Connection of the two frames: the support frame 2 and the mounting frame 3 is implemented in such a way that the support frame 2 is made of just one section profile which, in its corners, features triangular cut-outs of support wall 21 and the rib 24, while the protective wall 22 and the lower protective wall 23 in these corners are folded, with a concurrent guidance of groove 25 to the tongue 31 of the mounting frame, and upon the closing of the circuit on one of the walls of the support frame, the opposite ends of the section profile are connected by means of rivets.

There is a flat seal 32 between the mounting frame 3 for window accessories and the framing X3 protruding from the roof. This seal is affixed to the underside of mounting frame 3.

Example 2

Figure 3:
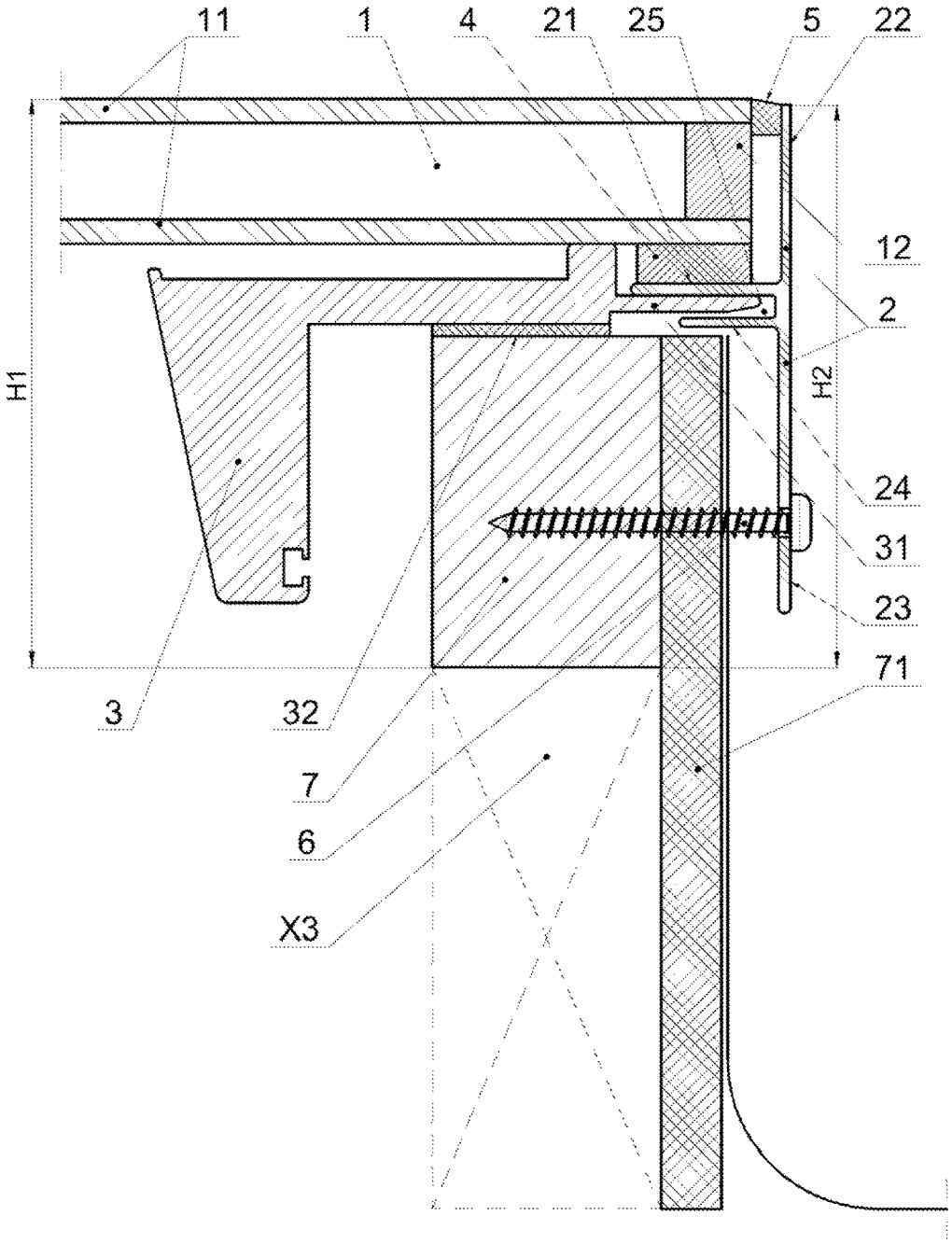
FIG. 3—A skylight with a mounting frame for window accessories and a window frame supported on a framing protruding from the roof—as a superimposed cross-section including the edge of the window and the indicated framing.

A fixed curb-mounted skylight, as shown in FIG. 3 of the drawing (which is a superimposed cross-section for all sides of the window) has a rectangular glazing unit 1 comprising two panes 11 connected at their periphery by a spacer frame 12. The support frame 2 of the glazing unit is made of section profile having a support wall 21 and protective wall 22, and also a lower protective wall 23 and a rib 25—the same as in the first embodiment. The support frame 2 and glazing unit 1 are connected by means of an adhesive fastening joint 4 applied to the support wall 21. The window also has a rectangular mounting frame 3 for optionally embedding on it window accessories, which is connected to the support frame 2 by means of its tongue 31 mounted in the groove 25 between the support wall 21 and the rib 25—the same as the in the first embodiment.

The window according to the second embodiment comprises a window frame 7 that is mounted on framing X3 protruding from the roof, and is secured to it by means of threaded fasteners (not shown in the drawing) situated at right angles to the roof. On a window frame 7 rests a mounting frame 3 for window accessories, and between this and window frame 7 is a seal 32, glued to the lower surface of the mounting frame. On the outer lateral surface of the window frame is a thermal insulation cap 71. This cap is extended in the direction of the roof, as a result of which it overlaps the lateral surface of framing X3, thus also insulating this area of the roof.

The distance H2 from the skylight support surface on framing X3 protruding from the roof, to the outermost edge of the protective wall 22 of the section profile of support frame 2, is slightly shorter than the distance H1 from the skylight support surface on framing X3 to the outer surface of pane 11 of the glazing unit. Between the glazing unit 1 and the protective wall 22 is an adhesive sealing joint 5—as in the first embodiment. In the assembled support frame, the lower protective walls 23 envelop the window frame 7. Support frame 2, and with it, the glazing unit 1 are attached to the window frame 7 embedded in it by means of screws 6 that pass through the openings in the lower protective wall 23.

Example 3

A curb-mounted skylight according to the third embodiment (not shown in the drawing) is an openable window. It has a glazing unit and a support frame connected by adhesive joints, and a mounting frame for window accessories and a window frame—all identical to those in the second embodiment. The glazing unit, support frame and mounting frame for window accessories together make up a movable window sash, embedded in the window frame by means of hinges, which in the sash are attached to the mounting frame. In view of this being a movable sash, in this embodiment there is no securing of the support frame by means of screws to the window frame; however, the window features a sash locking unit in a closed position.

Example 4

Figure 4:
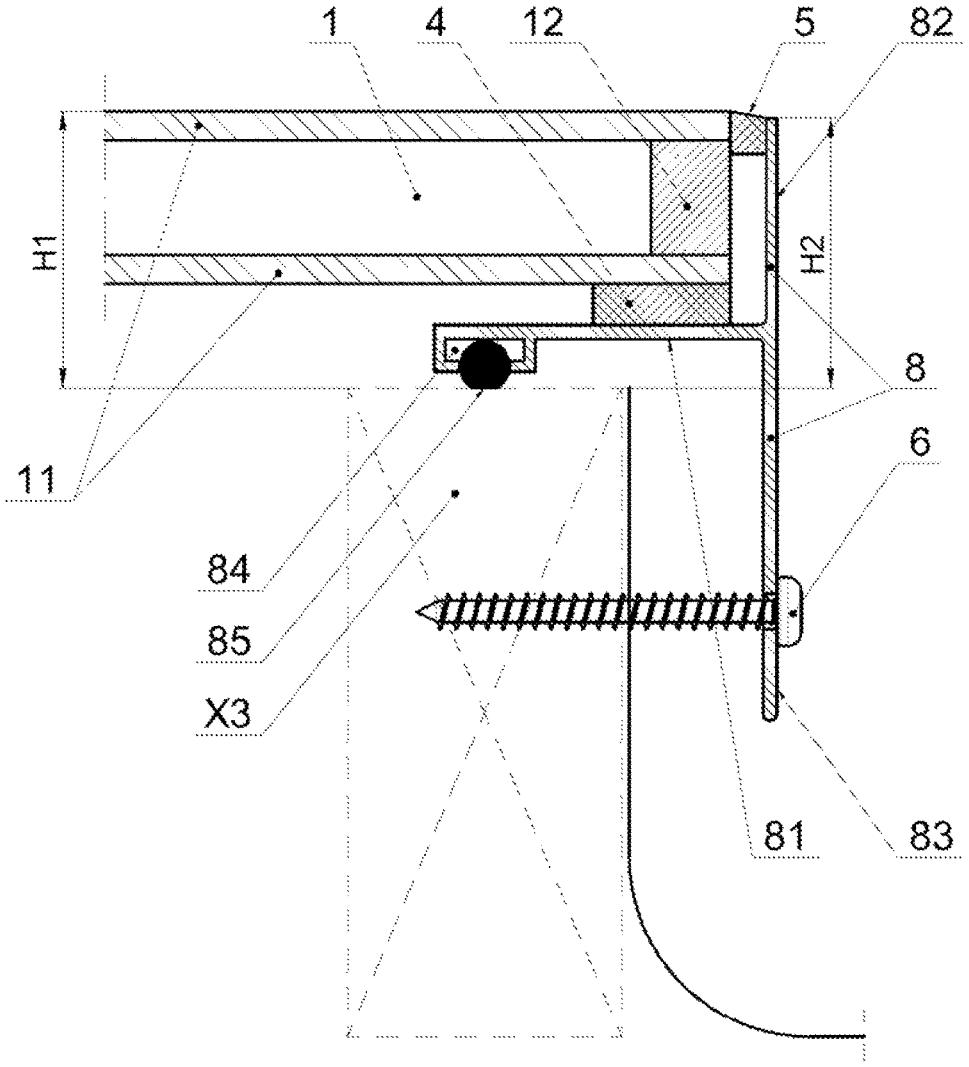
FIG. 4—A skylight with a glazing unit support frame supported on a framing protruding from the roof—as a superimposed cross-section including the edge of the window and the indicated frame.

A fixed curb-mounted skylight, as shown in FIG. 4 of the drawing (which is a superimposed cross-section for all sides of the window), has a rectangular glazing unit 1 comprising two panes 11 connected at their periphery by a spacer frame 12. The support frame 8 of the glazing unit is made of a section profile having a support wall 81, a protective wall 82 and a lower protective wall 83. The support frame 8 and the glazing unit 1 are connected by means of an adhesive fastening joint 4 applied to the support wall 81, and this wall has a groove 84 on its lower surface, and in this groove, is fitted a seal 85 with a circular cross-section, which adjoins the framing X3 protruding from the roof and forming part of the roof.

The distance H2 from the skylight support surface on the framing X3 protruding from the roof to the outermost edge of the protective wall 82 of the section profile of the support frame 8, is slightly shorter than the distance H1 from the skylight support surface on the framing X3, to the outer surface of pane 11 of the glazing unit. There is an adhesive fastening joint 5 between the glazing unit 1, and the protective wall 82—as in the first embodiment.

The section profile of the support frame 8 also has a lower protective wall 83 located below the support wall 81, on an extension of the protective wall 82. In the installed support frame 8, lower protective walls 83 envelop framing X3 protruding from the roof. The lower protective walls 23 also serve for securing the skylight to the roof by means of screws 6 which pass through openings in the lower protective wall 83 and are mounted in the framing X3.

What is claimed is:

1. A curb-mounted skylight window, arranged to be mounted on a framing protruding from a roof and forming a part of the roof with a range of incline from 0 to 85 degrees, comprising:

a glazing unit including at least two panes separated by a space filled with a gas, wherein the glazing unit is rectangular in shape, widths of the at least two panes are identical and lengths of the at least two panes are identical, a support frame surrounding the glazing unit, wherein the support frame is made of a section profile having a support wall and a protective wall, while a distance from a support surface of the skylight on the framing protruding from the roof to an outermost edge of the protective wall is no longer than a distance from the support surface of the skylight to an outer surface of the glazing unit, wherein the outermost edge is the farthest edge of the protective wall from the framing;

an adhesive sealing joint disposed between the glazing unit and the protective wall, wherein the adhesive sealing joint keeps the glazing unit away from an upper surface of the support wall by a gap, an outer surface of the adhesive sealing joint that connects the outer surface of the glazing unit with the outermost edge of the protective wall is oblique with respective to the outer surface of the glazing unit, forming a chamfered edge.

2. The curb-mounted skylight window according to claim 1, wherein the section profile of the support frame of the glazing unit has a lower protective wall positioned below the support wall on an extension of the protective wall.

3. The curb-mounted skylight window according to claim 2, wherein the section profile of the support frame of the glazing unit has a rib located below the support wall, and between the rib and the support wall there is an attachment groove in which is mounted a profiled strip for attaching window accessories.

4. The curb-mounted skylight window according to claim 3, wherein the profile strips are arranged along all sides of the glazing unit, forming a mounting frame for window accessories.

5. The curb-mounted skylight window according to claim 4, wherein the mounting frame rests on the framing protruding from the roof, while there is a flat seal between the mounting frame for window accessories and the framing protruding from the roof.

6. The curb-mounted skylight window according to claim 4, wherein a window frame is mounted on the framing protruding from the roof, while there is a flat seal between the mounting frame for window accessories, and the window frame.

7. The curb-mounted skylight window according to claim 2, wherein the skylight has a window frame mounted on the framing protruding from the roof, while there is a flat seal between the support wall of the section profile enveloping the glazing unit and the window frame.

8. The curb-mounted skylight window according to claim 2, wherein in the support wall, on a lower surface of the curb-mounted skylight window there is a seal mounted in a groove.

9. The curb-mounted skylight window according to claim 1, wherein the section profile of the support frame of the glazing unit has a rib located below the support wall; and an attachment groove is provided between the rib and the support wall, wherein one or more profiled strips are mounted for attaching window accessories.

10. The curb-mounted skylight window according to claim 9, wherein the profiled strips are arranged along all sides of the glazing unit, forming a mounting frame for the window accessories.

11. The curb-mounted skylight window according to claim 10, wherein the mounting frame rests on the framing protruding from the roof, and a flat seal is provided between the mounting frame for window accessories and the framing protruding from the roof.

12. The curb-mounted skylight window according to claim 10, wherein a window frame is mounted on the framing protruding from the roof, and a flat seal is provided between the mounting frame for window accessories and the window frame.

13. The curb-mounted skylight window according to claim 12, wherein on outer lateral surfaces of the window frame, there are thermal insulation caps overlapping the lateral surfaces of the framing protruding from the roof.

14. The curb-mounted skylight window according to claim 1, wherein a window frame is mounted on the framing protruding from the roof, and a flat seal is provided between the support wall of the section profile enveloping the glazing unit and the window frame.

15. The curb-mounted skylight window according to claim 14, wherein on outer lateral surfaces of the window frame, there are thermal insulation caps overlapping the lateral surfaces of the framing protruding from the roof.

16. The curb-mounted skylight window according to claim 1, wherein in the support wall, on a lower surface of the curb-mounted skylight window there is a seal mounted in a groove.

17. The curb-mounted skylight window according to claim 1, wherein the gas is argon.

18. The curb-mounted skylight window according to claim 1, wherein the protective wall completely surrounds a perimeter of a portion of the glazing unit located in the support frame.

19. A curb-mounted skylight window, arranged to be mounted on a framing protruding from a roof and forming a part of the roof with a range of incline from 0 to 85 degrees, comprising:

a glazing unit including at least two panes separated by a space filled with a gas, wherein the glazing unit is rectangular in shape, widths of the at least two panes are identical and lengths of the at least two panes are identical, a support frame surrounding the glazing unit, wherein the support frame is made of a section profile having a support wall and a protective wall, wherein the outermost edge of the protective wall ends slightly below an outer surface of the glazing unit;

an adhesive sealing joint disposed between the glazing unit and the protective wall, wherein the adhesive sealing joint keeps the glazing unit away from an upper surface of the support wall by a gap, an outer surface of the adhesive sealing joint that connects the outer surface of the glazing unit with the outermost edge of the protective wall is oblique with respective to the outer surface of the glazing unit, forming a chamfered edge.

* * * * *